United States Patent [19]

Whelan et al.

[11] 3,954,263

[45] May 4, 1976

[54] GROWTH MATERIAL AND GROWTH TEE

[76] Inventors: James D. Whelan; George Spector, both of 3615 Woolworth Bldg., 233 Broadway, New York, N.Y. 10007

[22] Filed: Apr. 8, 1974

[21] Appl. No.: 458,907

[52] U.S. Cl. ..... 273/33; 47/48.5; 71/64 F

[51] Int. Cl.[2] ..... A63B 57/00

[58] Field of Search ..... 273/33, 202–212; 47/48.5; 71/64 E, 64 F, 64 G

[56] References Cited

UNITED STATES PATENTS

| | | | |
|---|---|---|---|
| 1,645,001 | 10/1927 | Hodges | 273/33 X |
| 1,717,318 | 6/1929 | Pugh | 273/208 X |
| 1,815,520 | 7/1931 | McLeod | 273/33 |
| 2,011,203 | 8/1935 | Seiki | 273/33 |
| 2,931,140 | 4/1960 | Laffler et al. | 47/48.5 |
| 3,264,089 | 8/1966 | Hansen | 71/64 F |
| 3,273,284 | 9/1966 | Anagnostov | 47/34 |
| 3,697,082 | 10/1972 | DiLaura et al. | 273/210 X |
| 3,884,479 | 5/1975 | Gordos | 273/33 |

*Primary Examiner*—Richard J. Apley
*Assistant Examiner*—Harry G. Strappello

[57] ABSTRACT

An improved golf tee for being used upon a golf course; the tee being made of a substance such as grass seed or plant food and a carrier material such as cellulose that serves as a binder to hold the substance together when molded into tee shape; the tee after becoming broken or lost in use on the golf course promoting grass growth, thus eliminating becoming scattered debris while at a same time improving the ecology.

2 Claims, 7 Drawing Figures

GROWTH MATERIAL AND GROWTH TEE

This invention relates generally to golf tees.

A principle object of the present invention is to provide an improved golf tee that is made of a grass seed or plant food compound so that after it becomes broken or lost upon the golf course, it promotes the grass growth instead of simply becoming scattered debris, such as those that are made of wood or plastic.

Another object is to provide a growth tee which has all the strength characteristics of a conventional wooden tee when used in playing a golf game, but none of its disadvantages once it becomes lost or broken.

Yet another object is to provide a growth material and growth tee which could be made up in different varieties of grass seed and plant foods so to particularly be suitable for different climate areas.

Still another object is to provide a growth material and growth tee which could be readily shredded by a golf course lawn mower so to scatter the beneficial composition.

Other objects are to provide a growth material and golf tee which is simple in design, inexpensive to manufacture, rugged in construction, easy to use and efficient in operation.

These and other objects will be readily evident upon a study of the following specification and the accompanying drawing wherein.

Figure 1:
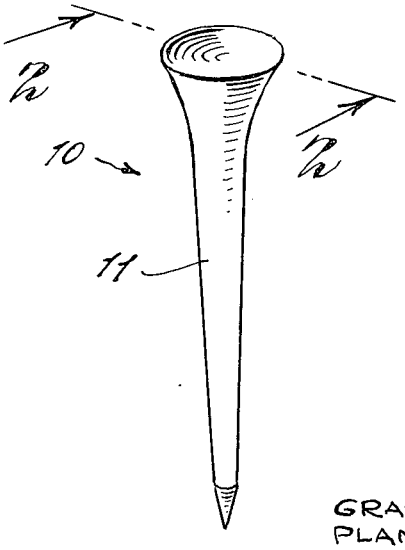
FIG. 1 is a perspective view of the invention
Figure 2:
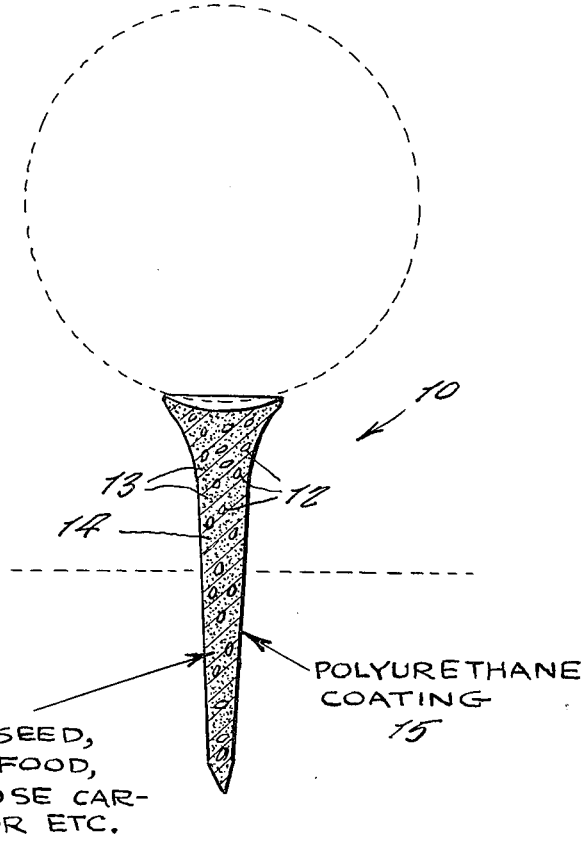
FIG. 2 is a cross sectional view thereof taken on line 2—2 of FIG. 1.

Referring now to the drawing in detail, and more particularly to FIGS. 1 and 2 thereof at this time, the reference numeral 10 represents a growth material and growth tee according to the present invention wherein there is a one piece peg or tee 11 that is designed in a conventional golf tee shape, but which is made from a growth material. The tee is molded from a compound that consists of grass seed 12 plant food 13 and a carrier material 14 such as cellulose so to bind the substance hard together after molding, so to replace a conventional wooden golf tee.

The tee could be manufactured in four or five different varieties of grass seed so to satisfy different climate areas.

The plant food could comprise fertilizer, enriched soil, peat or the like. The growth material may be formed in many shapes and sizes such as rods, dolls, pellets or flakes, and is suitable for spreading on top or implanting into soil.

The exterior of the molded tee is coated with a polyurethane coating 15 so that decomposing process will not take place until the growth tee is either broken or is cut with a grass mower so to break through the protective coating 15 and expose the growth material to moisture, so to decompose the tee within two or three weeks under normal conditions. Thus new plant life is promoted on the fair ways and near tee off areas.

The hardness of the tee 11 is equivalent to that of conventional wooden tees so to not scratch, dent nor mark the golf club face. While not being harder then wood, it should not be softer, so that the tee thus will not necessarily break the first time that it is used, but may possibly be used several times such as a conventional wooden one.

For reasons of more broadly protecting the present invention, several different modified designs thereof are included in FIGS. 3 through 7, all of which are made of the above described growth material, some of which include stress areas where breakage is most likely to occur if the tee is due to breakage as a result of the club drive force.

Figure 3:
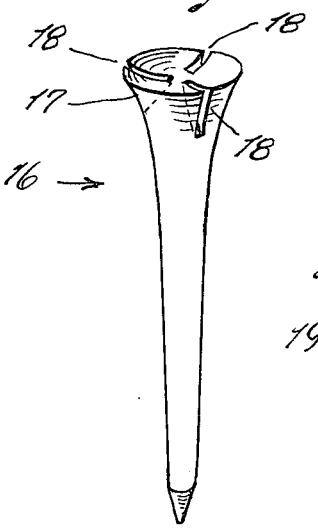
FIG. 3 shows a modified design of the invention in which the head is slotted for breakage location when a ball is teed off.

In FIG. 3, a growth tee 16 has a head 17 that has radial slots 18.

Figure 4:
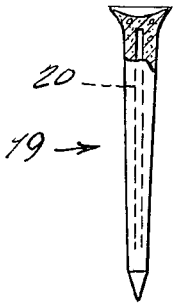
FIG. 4 is another modified design in which a closed central hole is uncoated so that once broken, the entire length of the tee is instantly exposed to moisture and water for decomposing.

In FIG. 4, a growth tee 19 includes a central, sealed hole 20. This hole can be either empty or it may be filled with loose seeds or plant food that instantly scatter whenever the tee is broken.

Figure 5:
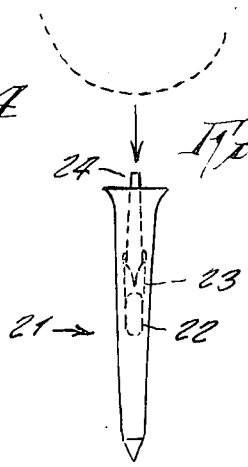
FIG. 5 is another modified design in which a pointed peg (made likewise of same material as the tee) is depressed by the golf ball so to puncture a polyurethane coated water reservoir so to expose the tee to the water for quicker decomposing.
Figure 6:
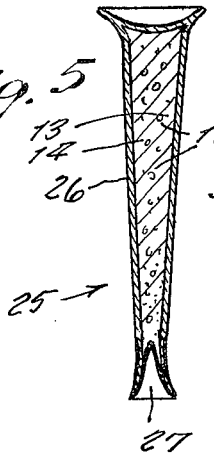
FIG. 6 shows another one time use growth tee.
Figure 7:
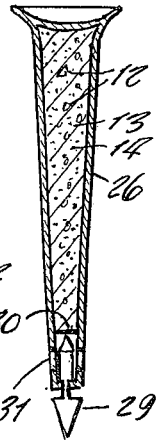
FIG. 7 shows still another design thereof.

FIGS. 5, 6 and 7 show growth tees for one time use only.

In FIGS. 5 a growth tee 21 includes pulyurethane coated water reservoir 22 inside central opening 23, which is punctured by pointed peg 24 (made of growth material) when downwardly pushed by the golf ball, so that leaking water instantly starts decomposition.

In FIG. 6, the growth tee 25 has a mica coating 26 instead of a polyurethane coating 15. The lower end of the tee has a flared bottom opening 27, the walls of which break when the tee is forced down into a ground.

In FIG. 7, mica coated, growth tee 28 includes pointed peg 29 slidable at the tee lower end so when forced down in a ground, punctures polyurethane coating 30 thereabove so to expose the growth material to windows 31 and exterior water or moisture.

Thus different forms of the invention have been presented.

It should be noted that other appropriate materials such as varnish, hard rubber, plastics, wax, fibreglass or the like can be used for coating 15.

The coating material used and the inner growth material will not jam or injure lawn mower blades as is the case in regard to conventional wood tees.

In connection with construction shown in FIGS. 6 and 7, it should be understood that coating 26 can be made of polyurethane or any other coating material referred to hereinabove.

It is further noted that the binding carrier material 14 is preferably made from carbohydrates having the empirical formula ($C_6 H_{10} O_5$) or maybe optionally made from cellulose flour, papiermache, gelatinous material, clay soil mixture or the like.

While various changes may be made in the detail construction it is understood that such changes will be within the spirit and scope of the present invention as is defined by the appended claims.

I claim:

1. A golf tee molded from a material comprised of grass seed, plant food and a cellulose carrier binder wherein the plant food and binder includes fertilizer and enriched soil in combination with a moisture proof exterior coating enclosing said material, wherein said coating is stiffer and harder than said material and wherein the combined hardness and stiffness of the coating and material is sufficient for ground insertion and to support a golf ball thereon, said tee having a ball-supporting head and a tip narrower than said head for ground insertion, said tip including a central bottom opening which flares outwardly and downwardly whereby the coating surrounding the opening is breakable upon insertion of said tip in the ground due to the pressure exerted by the earth upon insertion.

2. A golf tee as in claim 1 wherein the coating is made from mica.

* * * * *